United States Patent [19]

Fries

[11] 4,236,805

[45] Dec. 2, 1980

[54] DEVELOPING APPARATUS FOR THE DRY DEVELOPMENT OF PHOTOSENSITIVE SHEET MATERIAL

[76] Inventor: Walter Fries, Hofbachstr, 12, 59 Siegen 21, Fed. Rep. of Germany

[21] Appl. No.: 36,758

[22] Filed: May 7, 1979

[30] Foreign Application Priority Data

May 9, 1978 [DE] Fed. Rep. of Germany ..... 2820133

[51] Int. Cl.[3] ..... G03D 7/00

[52] U.S. Cl. ..... 354/300; 34/155; 34/242

[58] Field of Search ..... 354/300, 318, 319, 324; 34/36, 115, 155, 242

[56] References Cited

U.S. PATENT DOCUMENTS

| | | | |
|---|---|---|---|
| 1,809,822 | 6/1931 | Allin | 354/300 |
| 2,240,409 | 4/1941 | Morse | 354/300 |
| 2,431,041 | 11/1947 | Hassler | 354/300 |
| 3,653,242 | 4/1972 | Schleich | 34/242 |
| 3,720,150 | 3/1973 | Hurtig et al. | 354/300 |
| 4,056,824 | 11/1977 | Iiyama et al. | 354/300 |
| 4,059,403 | 11/1977 | Barto et al. | 354/300 |
| 4,092,658 | 5/1978 | Schroter | 354/300 |
| 4,109,268 | 8/1978 | Schroter et al. | 354/300 |
| 4,166,728 | 9/1979 | Degenhardt et al. | 354/300 |

FOREIGN PATENT DOCUMENTS

| | | | |
|---|---|---|---|
| 2523228 | 3/1976 | Fed. Rep. of Germany | 354/300 |
| 2639778 | 3/1977 | Fed. Rep. of Germany | 354/300 |
| 2726240 | 2/1978 | Fed. Rep. of Germany | 354/300 |
| 2392418 | 12/1978 | France | 354/300 |
| 7607793 | 9/1977 | Netherlands | 354/300 |
| 329409 | 6/1958 | Sweden | 354/300 |

*Primary Examiner*—L. T. Hix
*Assistant Examiner*—Alan Mathews
*Attorney, Agent, or Firm*—Karl F. Ross

[57] ABSTRACT

A developing device for the dry development of exposed photosensitive material, e.g. blueprint paper, by a gas or vapor developer comprises a housing formed with shielding chambers which prevent the escape of the vapor into the environment. According to the invention, a pair of shielding chambers are provided at the inlet and outlet sides of the developing chamber and each is subdivided, in the direction of movement of the sheet, into at least two compartments, preferably with flexible wall members which form a lip seal with a surface over which the sheet is intended to ride. The compartments are evacuated.

8 Claims, 1 Drawing Figure

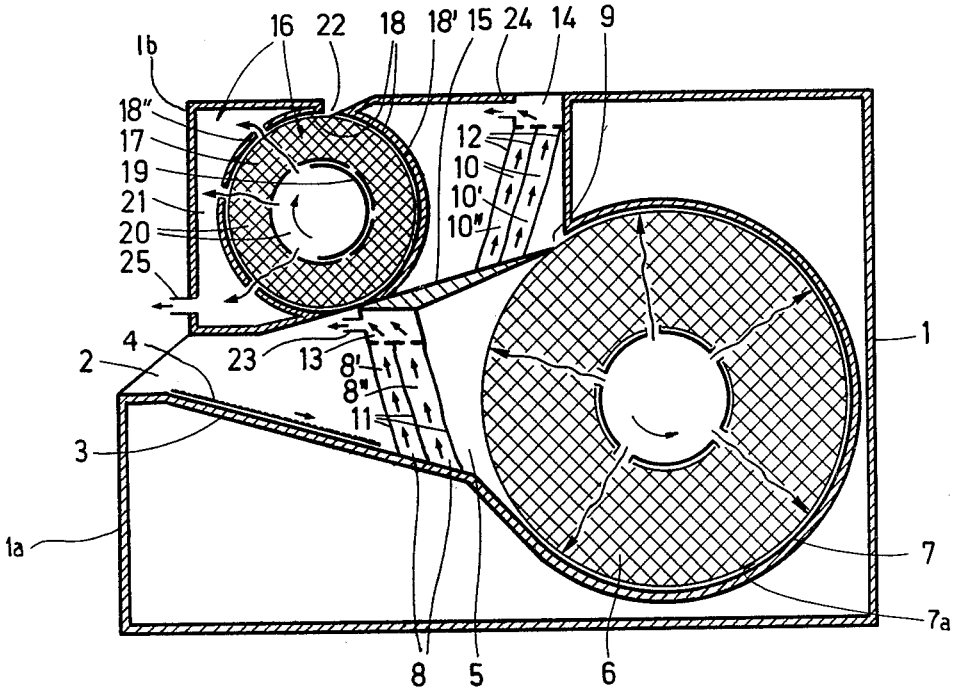
16
22
18
18'
15
24
14
9
1b
18"
17
19
21
20
25
12
10
10'
10"
1
4
2
23
13
8'
8"
11
3
1a
7
7a
8
5
6

DEVELOPING APPARATUS FOR THE DRY DEVELOPMENT OF PHOTOSENSITIVE SHEET MATERIAL

FIELD OF THE INVENTION

This invention relates to an apparatus for the dry development of exposed photosensitive sheet material and, more particularly, to a device for developing blueprints or the like by treating them with a gaseous or vapor developing medium.

BACKGROUND OF THE INVENTION

It is known to pass photosensitive sheet material, after exposure in a suitable device, through a developing unit in which the photosensitive surface is treated with a gaseous or vapor medium for so-called dry development.

In blueprint-making processes and the like, for example, the blueprint after exposure can be transported through a housing of the developer unit by appropriate transport rollers and there contacted with ammonia vapors or some other developing agent in a gaseous state.

Because of the noisome or toxic nature of the vapor or gaseous medium it is known to provide locks or shielding chambers at the inlet and outlet sides of the developing chamber to prevent or limit the escape of the gas or vapor to the environment. In German patent documents (Auslegeschrift) DE-AS No. 25 23 228 and DE-AS No. 27 26 240, for example, apparatus for the dry development of blueprints of the aforedescribed type is described. In these systems both the incoming and outgoing shielding chambers are provided with pairs of rollers which act in part as transport rollers for the sheet material and in part as a barrier to escape of any gaseous or vapor medium into the ambient atmosphere. A second pair of rollers is disposed between each shielding chamber and the developing chamber to seal the latter, to a certain degree, against excessive transfer of the gas or vapor from the developing chamber to the respective shielding chamber.

However, during operation of the developing unit, the pairs of rollers are continuously driven as is unavoidable if they are to function at least in part as the transport means for the paper. It has been found that portions of the gaseous or vapor developing medium tend to deposit upon and accumulate by adhesion upon these rollers so that it is unavoidable that at least to a certain extent the developing medium is carried by the outer pairs of rollers into the ambient atmosphere. The result is a noisome odor in the region of the device and possibly a toxic condition.

OBJECTS OF THE INVENTION

It is an object of the present invention, therefore, to provide a developing device which avoids the disadvantages described above and enables operation of a developing device with a minimum release of vapor or gaseous developing medium into the atmosphere.

Another object of the invention is to provide an improved developing device for blueprints and the like to be treated with gaseous or vapor developing agents such as ammonia, which precludes the release of even traces of the developing medium into the environment.

SUMMARY OF THE INVENTION

These objects and others which will become apparent hereinafter are attained, in accordance with the present invention, in a developing device or apparatus for exposed photosensitive sheet materials, especially blueprints, with a gaseous or vapor developer (e.g. ammonia) by a dry developing process, which is free from any moving part at the inlet to the shielding chamber initially traversed by the sheet material or at the outlet to the shielding chamber traversed by the sheet material upon leaving the development chamber.

According to a feature of the invention, upon traversing the latter shielding chamber, the sheet material is subjected, within the housing of the developing apparatus to a relatively long transport path at which residual vapors and moisture are removed from the sheet material.

More specifically, the objects of the present invention are attained by providing a developing apparatus or device which is formed with a housing having a developing chamber preferably of sectoral cross section and receiving a transport drum about which the sheet material is guided during the treatment thereof with the gaseous or vapor developer. At the inlet side of this developing chamber, there is provided a first shielding chamber while a second shielding chamber is provided at the outlet side of the developing chamber, each of the shielding chambers being subdivided in the direction of movement of the sheet material, into a plurality of compartments which are evacuated. Each shielding chamber thus may be defined by a plurality of shielding surfaces which successively engage the sheet material in the direction of movement thereof and which define between them the evacuated compartments mentioned previously.

Within the housing, moreover, there is provided a degassing chamber which is traversed by the sheet material after it leaves the second shielding chamber and which can have a further transport means, e.g. a drum, about which the sheet material is guided, the degassing chamber also being evacuated.

According to a feature of the invention, the shielding surfaces are formed from flexible materials and free ends which are deflectable by the leading edge of the sheet material from contact with a juxtaposed surface with which these free ends form a lip-type seal. These flexible shielding surfaces can be elastically yieldable synthetic-resin foils which are inclined in the direction of movement of the sheet material toward the aforementioned juxtaposed surfaces with which they form gas-tight lip seals. The latter surfaces may be planar. Apart from the free edge of these elastically deflectable foils, the remaining agents may be held in a gas-tight manner within the housing.

According to another feature of the invention, the degasification chamber is subdivided by the transport device, i.e. the second drum into a superatmospheric pressure zone and a subatmospheric zone, the latter serving to evacuate residual vapors and gas while the former can introduce a sparging fluid, e.g. hot air, to assist in vaporizing residues from the developed sheet material. The flow connections between the superatmospheric and subatmospheric regions can be effected through the wall of the transport device.

While both the developing chamber and the degasification chamber can have developing devices of various types, it has been found to be advantageous to provide the transport device as drums of porous material through which the fluids can pass from the interior toward the exterior. In the case of the developing chamber, the fluid is the gaseous or vapor developing medium while in the case of the degasification chamber, the fluid is the sparging gas, e.g. hot air, mentioned previously.

The degasification or sparging medium effects an optimum removal of residual moisture from the blueprint material, especially when it is directed against the reverse side of the sheet material, i.e. the side thereof opposite that which is provided with the image during the development process. The vapors released and entrained by the sparging gas are carried away through openings of the wall confronting the developed surface, the blueprint sheet lying against the transport roller or drum from which the heating fluid passes into contact with the sheet material.

The apparatus of the present invention has been found to be most advantageous when one or more of the compartments of the shielding chambers communicates within the body of the housing of the apparatus with the reduced pressure space from which the degasification medium is withdrawn, i.e. the shielding chambers defined by the shielding surfaces or curtains and the reduced-pressure region of the degasification chamber having a common suction source. According to the invention, the path of the sheet material is generally S-shaped with the obverse side of the sheet passing juxtaposed with the surface of the transport roll or drum in the developing chamber and the regions of the sheet lying against the roll or drum in the degasification chamber. This system prevents damage to the photosensitive coating prior to full development in the degasification chamber while ensuring intensive action by the developing agent emerging from the porous surface of the drum in the developing chamber. Since the degasification or sparging medium attacks the sheet material in a direction opposite that at which the material is contacted by the developing gas, a particularly intensive removal of residual moisture and vapors is obtained.

BRIEF DESCRIPTION OF THE DRAWING

The above and other objects, features and advantages of the present invention will become more readily apparent from the following description, reference being made to the accompanying drawing in which the sole FIGURE is a vertical cross-sectional view through an apparatus embodying the invention, with portions thereof being shown diagrammatically.

SPECIFIC DESCRIPTION

The developing unit shown in the drawing comprises the housing 1 which has a cylindrical segmented wall 7 defining a developing chamber 7*a* and enclosing a gas-permeable drum 6 journaled in the opposite side walls of the housing (not shown) and driven by conventional means.

At the inlet side of the housing, the vertical walls 1*a* and 1*b* are spaced apart to define an inlet slot 2 reaching toward the developing chamber 7*a* and bounded by a downwardly and inwardly inclined surface 3 forming a platform upon which the exposed photosensitive sheet 4 can be fed to the developing chamber. The photosensitive surface of the sheet of the blueprint paper is turned upwardly.

The inlet channel 2 opens into the general cylindrical space 5 formed by the wall 7 and receiving the transport drum 6 whose periphery forms a clearance from the wall 7 and thus defines the developing chamber 7*a* therewith.

Ahead of the developing chamber 7*a* a first shielding chamber 8 is provided and at the discharge side, formed with a ramp 15, a second or outlet shielding chamber 10 is formed.

Each of the shielding chambers 8, 10 is defined by a plurality (preferably three) elastically deformable shielding curtains 11, 12 whose lower ends rest upon the surfaces 3 and 15, respectively, by the intrinsic electricity of these foil members.

The vertical and upper edges of these foils are sealed in the housing.

The deformable shielding curtains 11 and 12 of the shielding chambers 8 and 10, respectively, define between them successive shielding compartments 8', 8'' and 10', 10''.

The compartments 8', 8'' communicate at their upper ends with a suction chamber 13 while the compartments 10', 10'' communicate at their upper ends with a suction chamber 14.

The shielding curtains 11 and 12 of the shielding chambers 8 and 10, preferably, are composed of flexible material with their lateral and upper edges hermetically sealed to the housing of the unit.

The free lower edges of the curtains 11 rest against the guide surface 3 of the inlet channels 2 with a lip seal while the free lower edges of the curtains 12 in a corresponding manner, rest upon the guide surface 15 at the outlet side of the developing chamber.

The guide surface 15 connects the outlet slot 9 of the developing chamber 7*a* with the inlet slot of a degassing chamber 16, the latter being provided with a further driven transport drum 17.

Like the transport drum 6 of the developing chamber, the transport drum 17 is formed from porous material and is positioned with relatively small clearance from the guide wall of the degassing chamber, the sheet being passed between the drum 17 and the wall 18.

The right-hand portion of the wall 18, shown at 18', is imperforate while the left-hand portion 18'' is perforated or gas-permeable.

The interior of the drum 17 is also subdivided into gas-passing and gas-blocking zones, e.g. by an impermeable shield 19 extending over the right half of the drum.

The drum 17 which subdivides the degassing chamber into a superatmospheric pressure zone 20 and a subatmospheric pressure zone 21, can have its interior connected with a pressurized source of hot air, e.g. a blower and heater, while a suction source such as a pump is connected at 25 to the evacuated paper 21 defined in the housing outwardly of the wall 18''.

The suction compartment 21 of the degassing chamber 16 and the suction chambers 13 and 14 of the shielding compartments are connected by the respective fittings 25, 23 and 24, to a common suction source. The drums 6 and 17 can be driven at the same peripheral speed by a conventional belt drive and electric motor, not shown.

In operation of the device, the blueprint sheet 4 is fed through the inlet 2 along the guide surface 3 beneath the lower edges of the deflectable curtains 11 into the developing chamber 5, 7*a* to be entrained along by the drum 6 into which the developing medium, e.g. ammonia, is fed centrally. The gaseous developing medium passes outwardly through the porous body of the drum 6 to develop the exposed surface of the sheet confronting the drum as the sheet is entrained to outlet 9 of the developing chamber.

Upon emerging from the outlet 9, the sheet passes over the guide surface 15 beneath the deflected edges of the curtains 12. The suction maintained in the shielding chambers 8 and 10 prevents the escape of the developing medium from the developing chamber 5, *7a*.

The residual developing medium impregnating the sheet is driven off in the degassing chamber 16 through which the sheet is entrained by the drum 17 along the permeable wall 18". In this case, the reverse side of the sheet engages the surface of the drum 17 through which the hot air is fed radially outwardly to entrain the residual developing medium as it is driven out of the blueprint paper into the chamber 21.

The sheet then emerges at the outlet slot 22 of the machine.

It has been found to be important that the curtains 11 and 12 be inclined at acute angles to the respective surfaces 3 and 15 in the direction of feed of the sheet there passed.

It has also been found to be important to provide an S pattern of movement of the sheet about the drums 6 and 17 with the exposed surface confronting the drum 6 and the reverse side of the sheet confronting the drum 17. The second drum 17 also does not come into contact with the image carrying surface.

Finally it should be noted that the suction chambers can be connected together within the housing or by separate fittings to the name or respective suction sources.

I claim:

1. In a device for developing an exposed sheet with a gas or vapor in a dry developing process, the improvement which comprises in combination:

a housing formed with a developing chamber, a first transport means in said developing chamber, and means for contacting said sheet in said developing chamber with a developing agent, said developing chamber having an inlet and an outlet for said sheets;

a first shielding chamber at said inlet in said housing and a second shielding chamber at said outlet in said housing for blocking the escape of said agent from said developing chamber, each of said shielding chambers being formed with a plurality of curtains defining between them respective compartments successively traversed by the sheet, and means for evacuating the compartments of each of said shielding chambers; and means defining a degassing chamber in said housing downstream of said second shielding chamber in the direction of movement of said sheet, said degassing chamber being provided with second transport means for advancing said sheet therethrough, such degassing chamber being subdivided by said second transport means into a superatmospheric pressure zone and subatmospheric pressure zone, said zones being in communication with one another through said second transport means, each of said transport means being a respective drum composed of porous material, the drum of said developing chamber being supplied with said agent and the drum of said degassing chamber being supplied with a degassing medium.

2. The device defined in claim 1 wherein said curtains are composed of flexible material and normally rest against respective guide surfaces for said sheet.

3. The device defined in claim 2 wherein said curtains are composed of elastically yieldable material, especially synthetic-resin foil, having free lower edges resting against said guide surfaces in lip seals.

4. The device defined in claim 3 wherein said curtains are inclined at acute angles to the respective guide surfaces in the direction of movement of said sheets.

5. The device defined in claim 1, further comprising imperforate wall means restricting the flow of degassing medium through only a portion of the drum of said degassing chamber.

6. The device defined in claim 5, further comprising common means for evacuating said compartments and said degassing chamber.

7. The device defined in claim 1 wherein said developing and degassing chambers are so constructed and arranged that said sheet passes with a photosensitive surface confronting said drum of said developing chamber and the reverse of said sheet confronting the drum of said degassing chamber.

8. In a device for developing an exposed sheet with a gas or vapor in a dry developing process, which comprises a housing formed with a developing chamber, a first transport means in said developing chamber, and means for contacting said sheet in said developing chamber with a developing agent, said developing chamber having an inlet and an outlet for said sheet, a first shielding chamber at said inlet in said housing and a second shielding chamber at said outlet in said housing for blocking the escape of said agent from said developing chamber, each of said shielding chambers being formed with a plurality of curtains defining between them respective compartments successively traversed by the sheet, and means for evacuating the compartments of each of said shielding chambers, and means defining a degassing chamber in said housing downstream of said second shielding chamber in the direction of movement of said sheet, said degassing chamber being provided with second transport means for advancing said sheet therethrough, the improvement wherein each of said transport means is a respective drum composed of porous material, the drum of said developing chamber being supplied with said agent and the drum of said degassing chamber being supplied with a degassing medium.

* * * * *